US007419112B2

(12) United States Patent
Sjöström et al.

(10) Patent No.: US 7,419,112 B2
(45) Date of Patent: Sep. 2, 2008

(54) REFINING SURFACE AND A BLADE SEGMENT FOR A REFINER

(75) Inventors: Håkan Sjöström, Tampere (FI); Vesa Arjanmaa, Tampere (FI); Per Fröberg, Tampere (FI); Petteri Vuorio, Valkeakoski (FI); Nils Virving, Hässelby (FI); Juha-Pekka Huhtanen, Tampere (FI); Matti Kaarineva, Lempäälä (FI)

(73) Assignee: Metso Paper, Inc., Helsinki (FI)

( * ) Notice: Subject to any disclaimer, the term of this patent is extended or adjusted under 35 U.S.C. 154(b) by 93 days.

(21) Appl. No.: 10/572,763

(22) PCT Filed: Oct. 6, 2004

(86) PCT No.: PCT/FI2004/000589

§ 371 (c)(1),
(2), (4) Date: Mar. 21, 2006

(87) PCT Pub. No.: WO2005/032720

PCT Pub. Date: Apr. 14, 2005

(65) Prior Publication Data

US 2007/0084952 A1 Apr. 19, 2007

(30) Foreign Application Priority Data

Oct. 6, 2003 (SE) ..... 0302646

(51) Int. Cl.
*B02C 7/12* (2006.01)

(52) U.S. Cl. ..... 241/298; 241/261.3

(58) Field of Classification Search ..... 241/296–298, 241/261.2, 261.3, 261.1
See application file for complete search history.

(56) References Cited

U.S. PATENT DOCUMENTS

| | | | |
|---|---|---|---|
| 4,023,737 | A | 5/1977 | Leider et al. |
| 4,676,440 | A | 6/1987 | Perkola |
| 5,165,592 | A | 11/1992 | Wasikowski |
| 5,467,931 | A | 11/1995 | Dodd |
| 5,476,228 | A | 12/1995 | Underberg |
| 5,690,286 | A | 11/1997 | Dodd et al. |
| 5,868,330 | A | 2/1999 | Dodd et al. |
| 5,893,525 | A | 4/1999 | Gingras |
| 6,592,062 | B1 | 7/2003 | Virving |
| 6,607,153 | B1 | 8/2003 | Gingras |

FOREIGN PATENT DOCUMENTS

| | | |
|---|---|---|
| FI | 53469 B | 5/1978 |
| SE | 513807 | 11/2000 |

*Primary Examiner*—Mark Rosenbaum
(74) *Attorney, Agent, or Firm*—Alston & Bird LLP

(57) ABSTRACT

A refining surface of a refining member, adapted for use with a refiner for defibrating a lignocellulose-containing material, is provided. Such a refining surface comprises a plurality of first grooves, each first groove being defined between two adjacent first bar portions of the refining surface, and extending between opposing first and second radial edges of the refining surface. The refining surface further comprises a plurality of second grooves, each second groove being defined between two adjacent second bar portions of the refining surface forming each first bar portion, and extending between two adjacent second grooves. The first bar portions are wider than the second bar portions, and each second bar portion are between about 1 mm and about 3 mm wide. A blade segment of a refining member is also provided.

28 Claims, 10 Drawing Sheets

REFINING SURFACE AND A BLADE SEGMENT FOR A REFINER

BACKGROUND OF THE INVENTION

1. Field of the Invention

Figure 1:
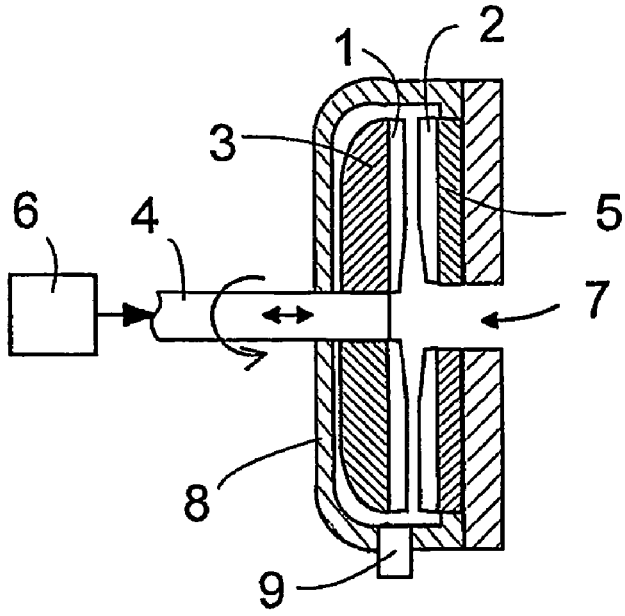

The invention relates to a refining surface of a refining member for a refiner intended for defibrating lignocellulose-containing material, the refiner comprising at least two refining surfaces arranged coaxially relative to each other, at least one of which refining surfaces is arranged to rotate around a shaft, and between which refining surfaces the material to be defibrated is fed, and which refining surface comprises first bars extending from the inner circumference of the refining surface to the outer circumference of the refining surface and between them first grooves, and the upper surfaces of which first bars further comprise second grooves connecting said first grooves, and between which second grooves there are second bars.

The invention further relates to a blade segment of a refining member for a refiner intended for defibrating lignocellulose-containing material, the refiner comprising at least two refining surfaces arranged coaxially relative to each other, at least one of which refining surfaces is arranged to rotate around a shaft, and between which refining surfaces the material to be defibrated is fed, and which blade segment can be arranged to form at least a part of at least one refining surface, and which blade segment comprises first bars extending from the inner circumference of the refining surface to the outer circumference of the refining surface and between them first grooves, and the upper surfaces of which first bars further comprise second grooves connecting said first grooves, and between which second grooves there are second bars.

2. Description of Related Art

Disc and cone refiners used for treatment of fibrous material are typically formed of two or possibly more refiner discs or refining members opposite to each other which are arranged to turn relative to each other so that at least one of said refiner discs is arranged to rotate around a shaft. In disc refiners the refiner disc is disc-like and in cone refiners it is conical. In a refiner comprising two refiner discs, one of the refiner discs further comprises an opening through which the material to be refined is fed into the refiner. The part of the refiner disc where said feed opening is located can be called a feed end. The refiner discs are positioned in such a way that they form a refiner gap between them, where lignocellulose-containing material is defibrated. The distance between the refiner discs is largest on the feed side or at the feed point of the lignocellulose-containing material, i.e., in a disc refiner, in the middle of the discs, and in a cone refiner, at the cone end having a smaller diameter, said gap being reduced towards the discharge point or discharge side of the material to be refined in order to gradually grind the material to be refined.

The refining surfaces of refiner discs or refining members are typically formed of protrusions, i.e. blade bars, extending from the inner circumference or first radial edge of the refining surface to the outer circumference or second radial edge of the refining surface, and of grooves between the blade bars. Hereafter, blade bars are also called bars. The shape of these grooves and bars per se may vary in different ways. Thus, for example, in the radial direction of the refiner disc, the refining surface may be divided into two or more circular parts, each circular part having bars and grooves whose number and density as well as their shape and direction may deviate from each other. Thus, the bars may be either continuous over the whole length of the refining surface radius or there may be a plurality of separate, successive bars in the radial direction. At the refiner rotor, the bars and the direction thereof have a greater effect than at the stator because of the rotation of the rotor, whereby the fibrous material to be refined is subjected especially by the rotor bars to a refining force resultant which affects with a velocity determined on the basis of the radius and rotational speed of the refining surface. The bars of the stator form counter pairs or a counter surface for the rotor, required in refining, the blade bars crossing each other during refining like scissor blades. However, there is a small clearance between the rotor bars and stator bars of the refiner, and the fibrous material is mainly ground or refined between them.

Refining surfaces of refiner discs or refining members can be formed directly onto the surface of the refining discs for example by casting or by separate machining but usually a refining surface is formed of blade segments which are arranged next to each other on the refiner disc both in the radial and in the circular or angular direction of the refiner disc so that the refiner disc is provided with a uniform refining surface. Thus, each blade segment forms a part of the refining surface of the refiner disc.

In the case of a disc refiner, the inner circumference or first radial edge of the refining surface refers to the middle part of the refining surface and, in the case of a cone refiner, to the end of said cone with the smaller diameter. The outer circumference or second radial edge of the refining surface refers, in the case of a disc refiner, to the outer part of the refining surface, i.e. the part where the circumference of the refining surface is largest, and, in the case of a cone refiner, to the end of said cone with the larger end.

Attempts have been made earlier to improve the load capacity or refining capacity of refiners by increasing the combined length of the refining surface bars. As a result, such blade or refining surface solutions have been designed and used, where blade bars are located closer and closer to each other. In such "dense blades", it is the volume or capacity of the grooves that determines the production capacity of the refiner blade. Due to the manufacture, blade bars typically have a clearance angle of 1 to 5°, which means that closer to the bottom of the groove the bar is thicker. This limits the groove volume even more. In addition, in cast blades the groove surfaces are rough, which causes flow resistance to the fibrous material to be refined. The narrower a groove is, the stronger becomes the flow resistance. A problem of these "dense blades" is, therefore, that they tend to be blocked. On the other hand, even the above mentioned blade solutions have not been successful in increasing the refiner capacity in a desired way.

U.S. Pat. No. 4,676,440 discloses a typical refiner blade for a high-consistency refiner. The blade formation of the publication consisting of blade segments is formed of three refining surface zones in the radial direction of the refiner disc, whereby in the outer zones of the refining surface the blade bars are positioned very close to each other in order to achieve a high refining capacity. Because of this, the volume of the grooves between the bars has become smaller. Therefore, on the refining surface of at least one of the refiner discs there is also one or more discharge channels having a substantially larger cross-section than said grooves in order to discharge steam generated during refining from between the refining surfaces. With these discharge channels, it has been possible to diminish the problems caused by steam generated during refining in the refining process, but the discharge channels may, however, make the refining more uneven and, in practice, the steam discharge channels described in the publication are arranged too sparsely with respect to each other.

U.S. Pat. No. 5,467,931 discloses a refining surface, wherein the efficiency of a refiner with densely arranged bars has increased due to a higher flow capacity of the refiner blades. Flow capacity has increased primarily because material has been chamfered away from the background edges of the blade bars. The publication also discloses a blade bar, the upper surface of which is provided with small grooves at sparse intervals, which can slightly increase the flow capacity of the grooves between the bars and facilitate the discharge of steam produced during refining from between the refining surfaces. Said grooves on the upper surface of the blade bar also add to the combined cutting length of the bars of the refining surface to some extent, but, in practice, the oblique structure of the upper surface of the blade bar hinders these small grooves from participating in the refining of the material before the blade bar has worn significantly, which means that one has not, nevertheless, succeeded in substantially increasing the refining capacity of the refiner.

BRIEF SUMMARY OF THE INVENTION

Embodiment of the present invention provide a new refining surface or blade solution for a refiner, enabling a higher refining capacity than previously.

The refining surface of the invention is characterized in that the second bars are narrower than the first bars.

Furthermore, the blade segment of the invention is characterized in that the second bars are narrower than the first bars.

According to the invention, at least one refining surface of a refining member of a refiner intended for defibrating lignocellulose-containing material comprises first bars extending from the inner circumference or first radial edge of the refining surface to the outer circumference or second radial edge of the refining surface and between them first grooves, and the upper surfaces of the first bars further comprise second grooves connecting said first grooves, between which second grooves there are second bars, which are narrower than the first bars. According to an embodiment of the invention, the average width of the first bar is 2.5- to 40-fold in respect of the average, combined width of the second bar and the second groove (combined unit). According to another embodiment of the invention, the total area of the refining zones of the refining surface formed of the second bars and the second grooves is 60 to 90%, preferably 70 to 80%, of the total area of the refining surface.

With the solution of the invention, a high cutting length can be achieved on the refining surface. Since the first grooves have a volume that is larger than previously, an optimal, steady feed of the fibrous material to be refined can be achieved over the entire area of the refining surface. The refining surface of the solution can thus provide both the desired capacity and a good quality of the refined pulp. Unlike before, the same refining surface solution can also be applied to the refining of both long and short fibers.

BRIEF DESCRIPTION OF THE SEVERAL VIEWS OF THE DRAWING(S)

Figure 2:
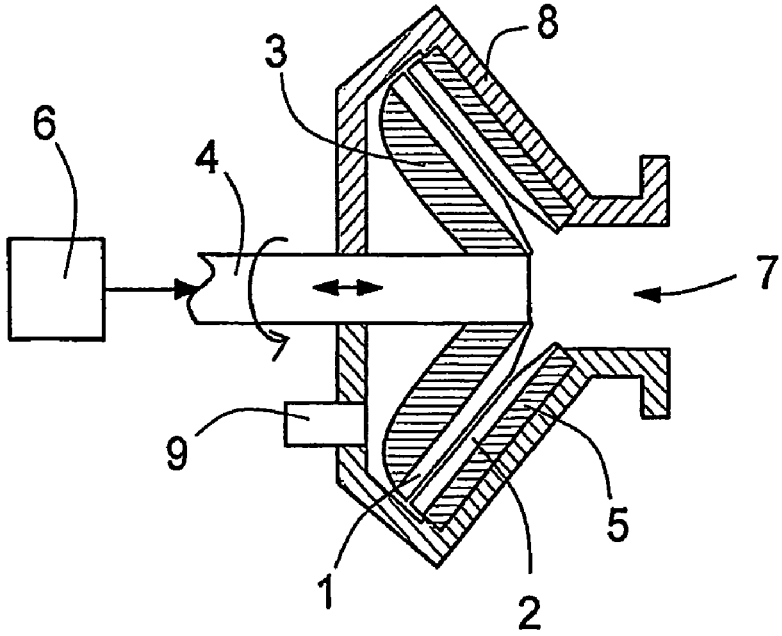
Figure 3:
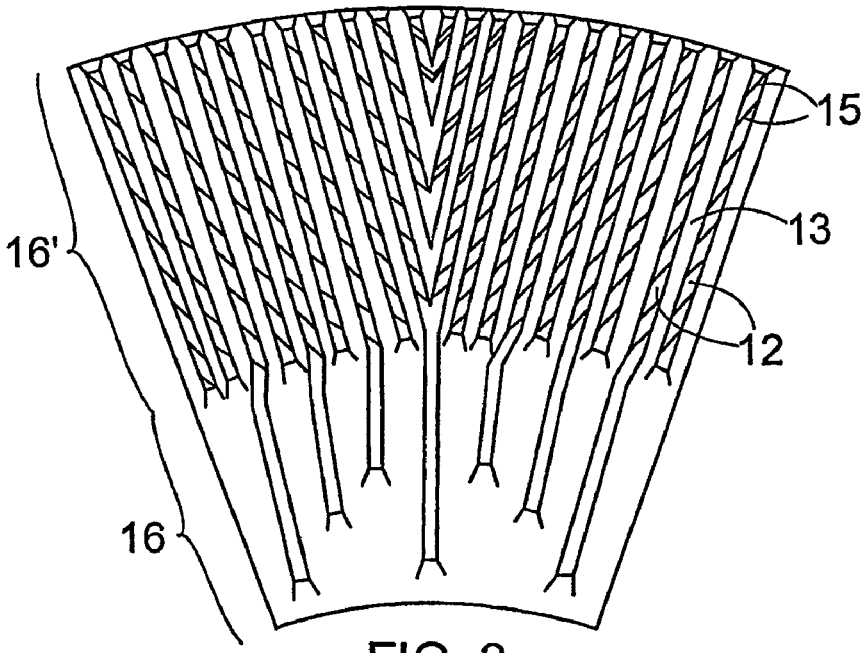
Figure 4:
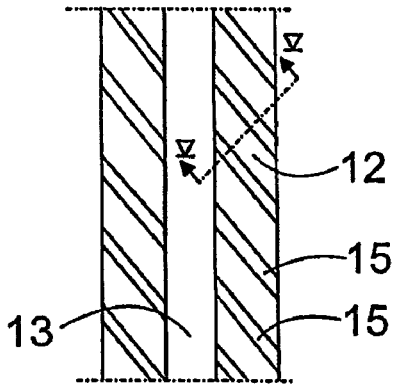
Figure 6:
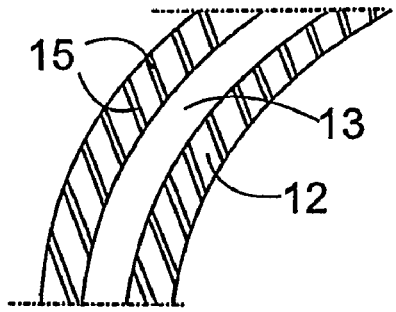
Figure 7:
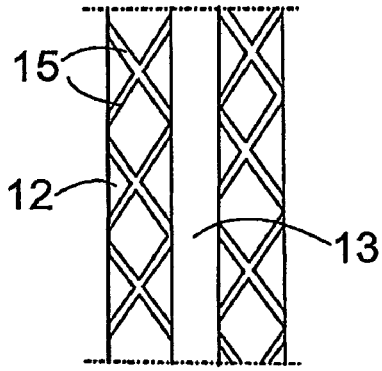
Figure 5:
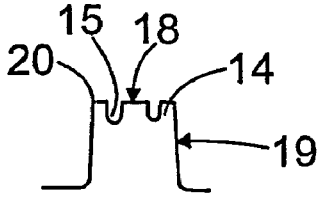
Figure 8:
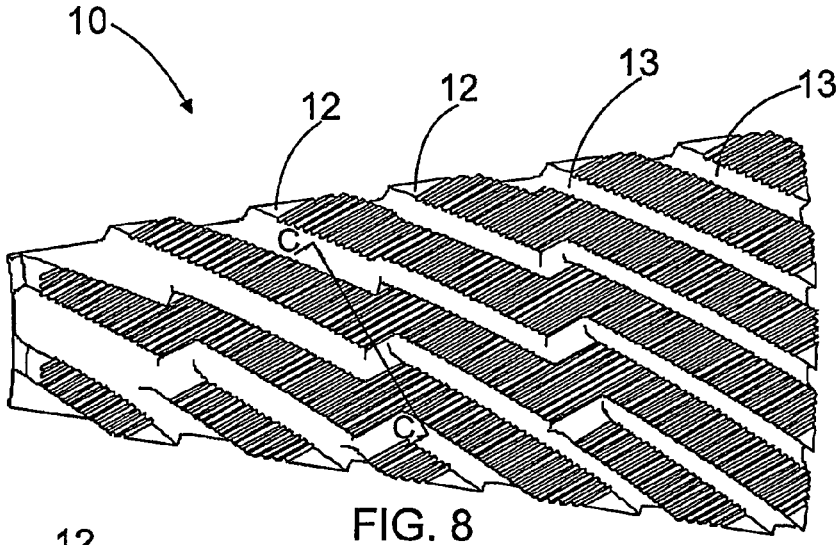
Figure 10:
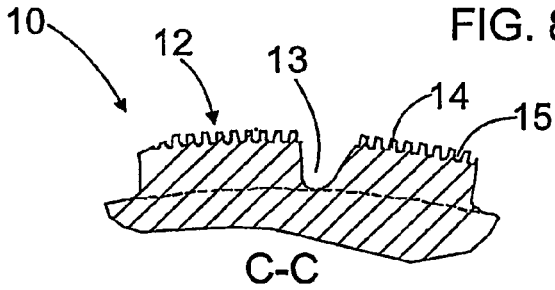
Figure 9:
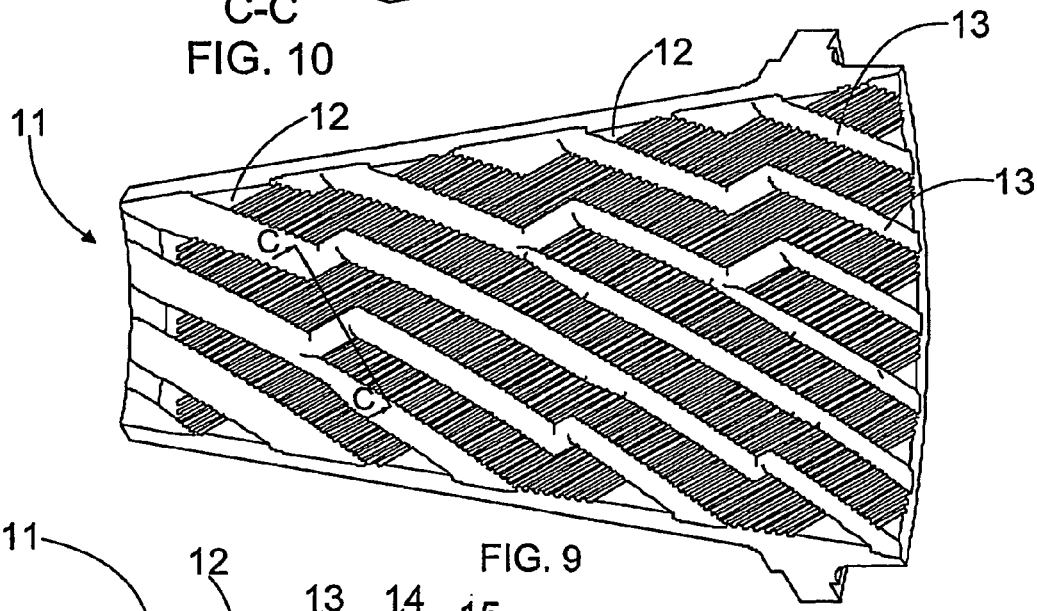
Figure 11:
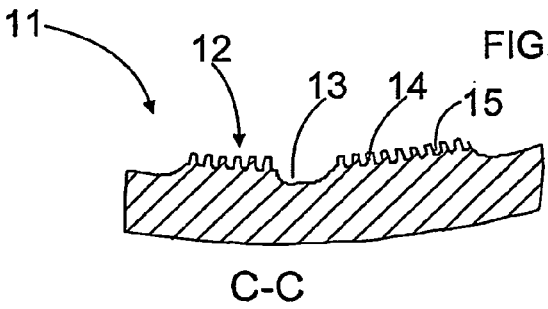
Figure 12:
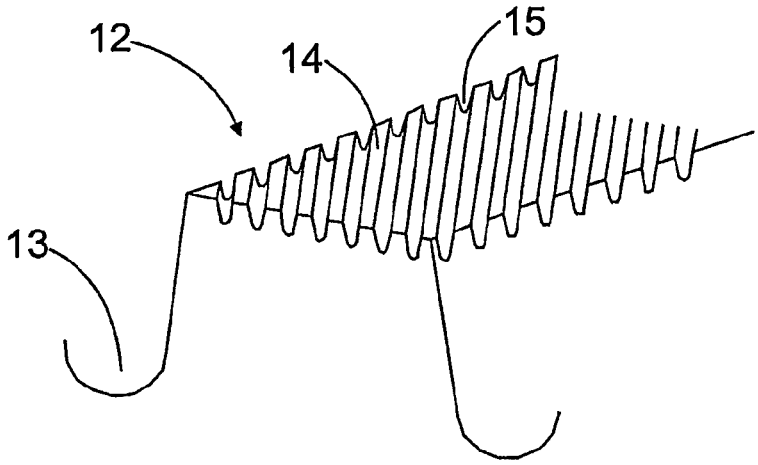
Figure 13:
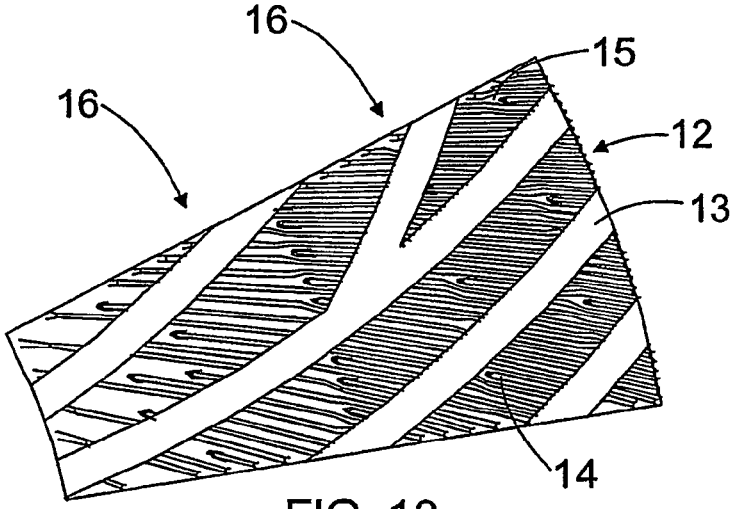
Figure 14:
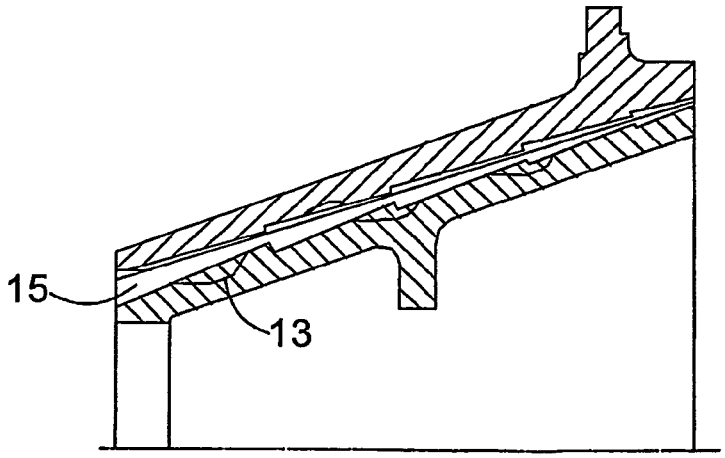
Figure 15A:
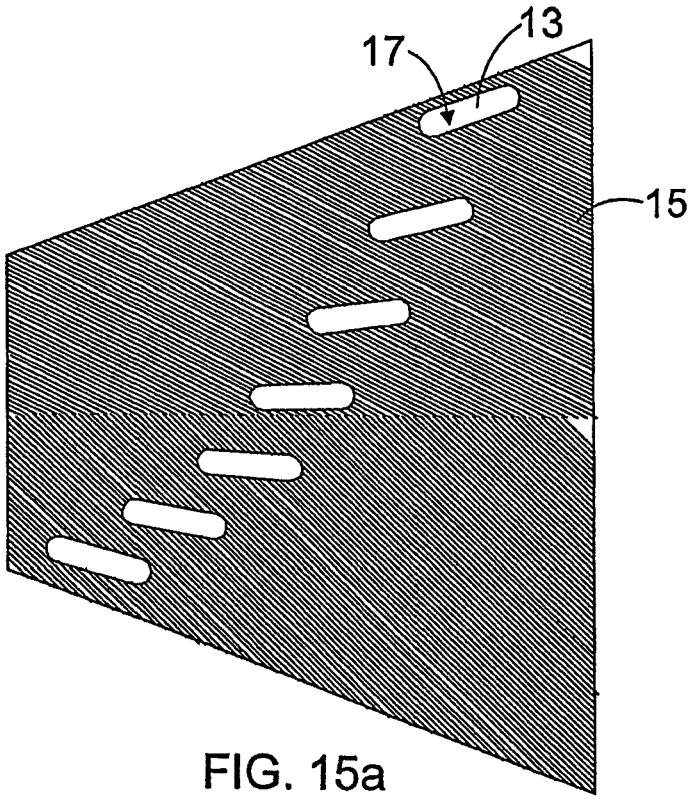
Figure 15B:
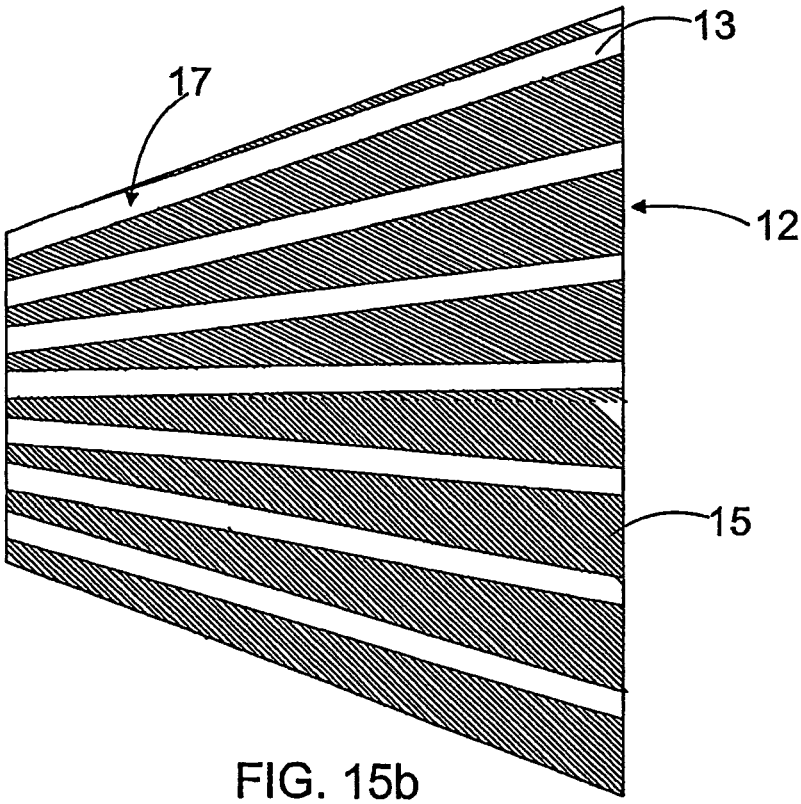
Figure 16A:
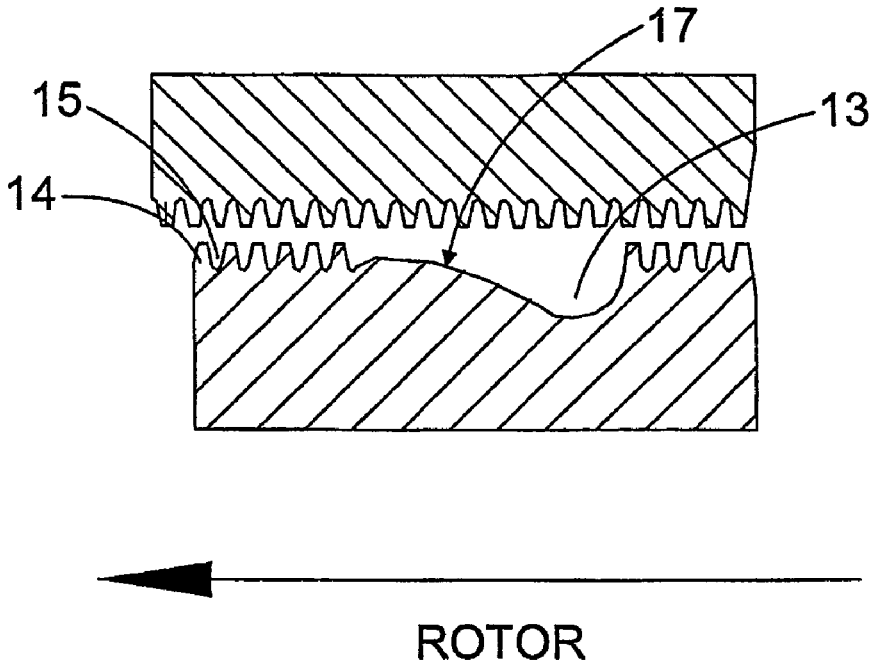
Figure 16B:
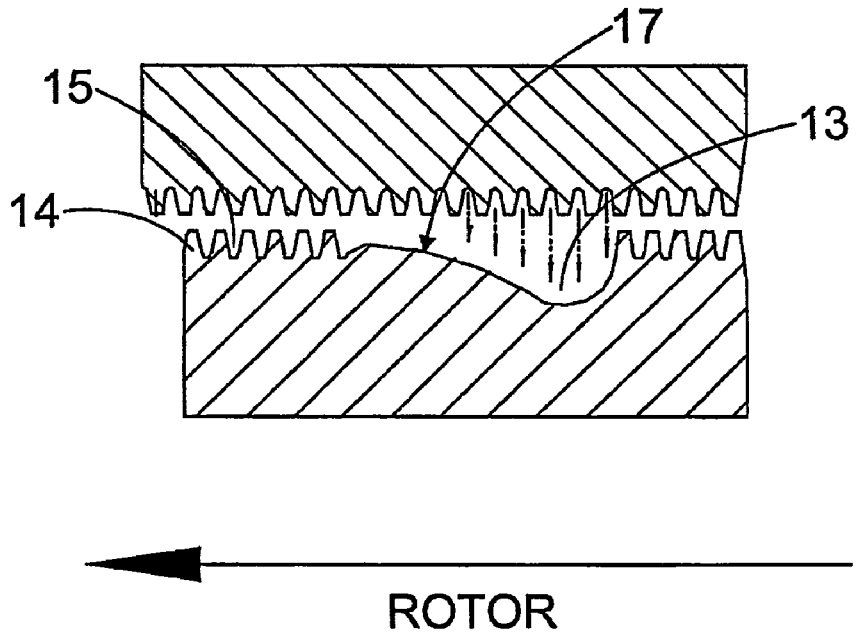
Figure 17:
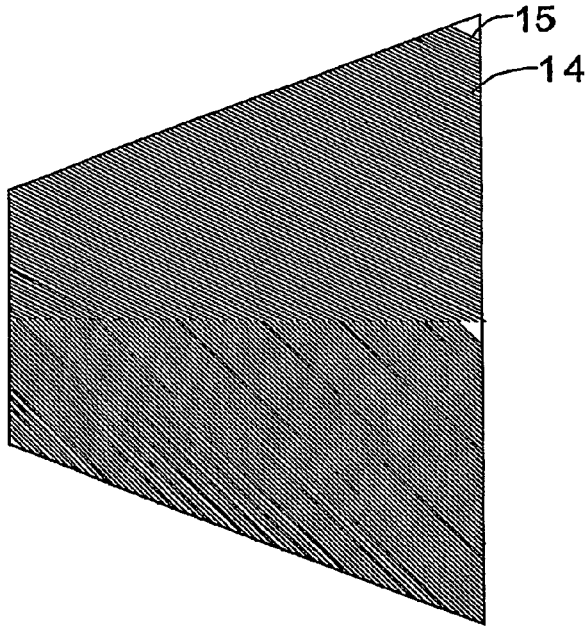
Figure 18:
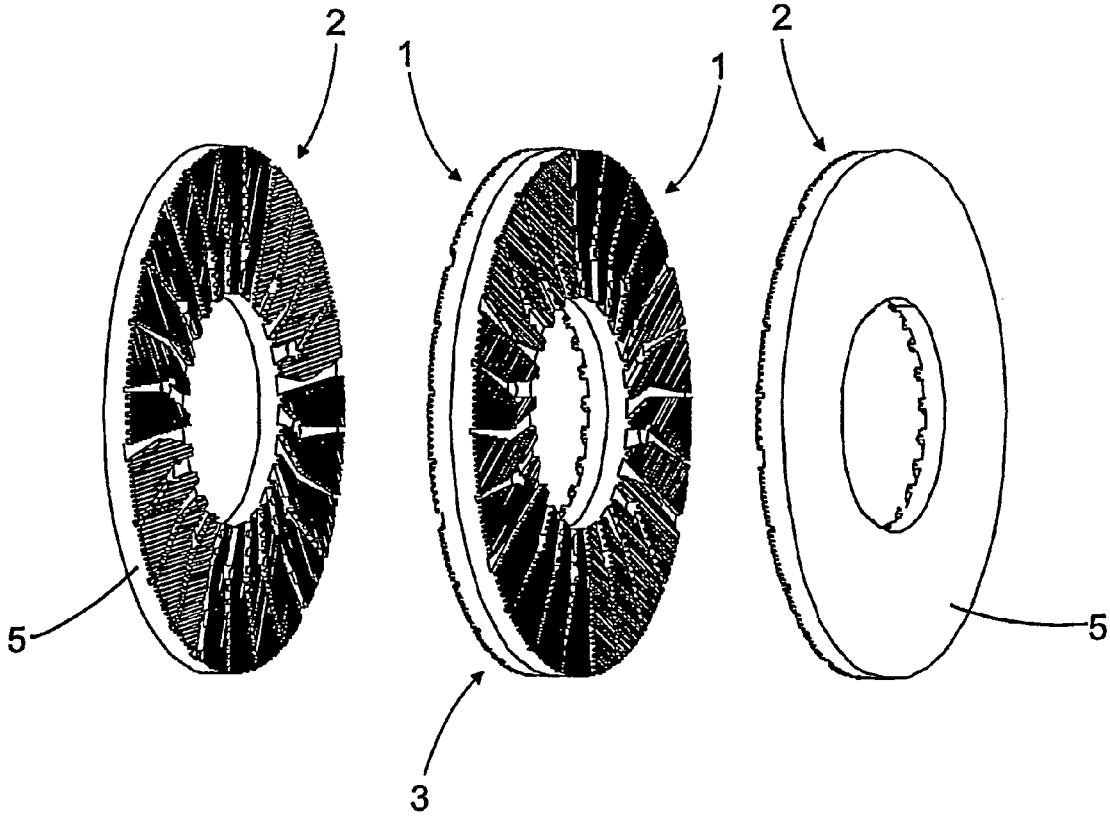
Figure 21:
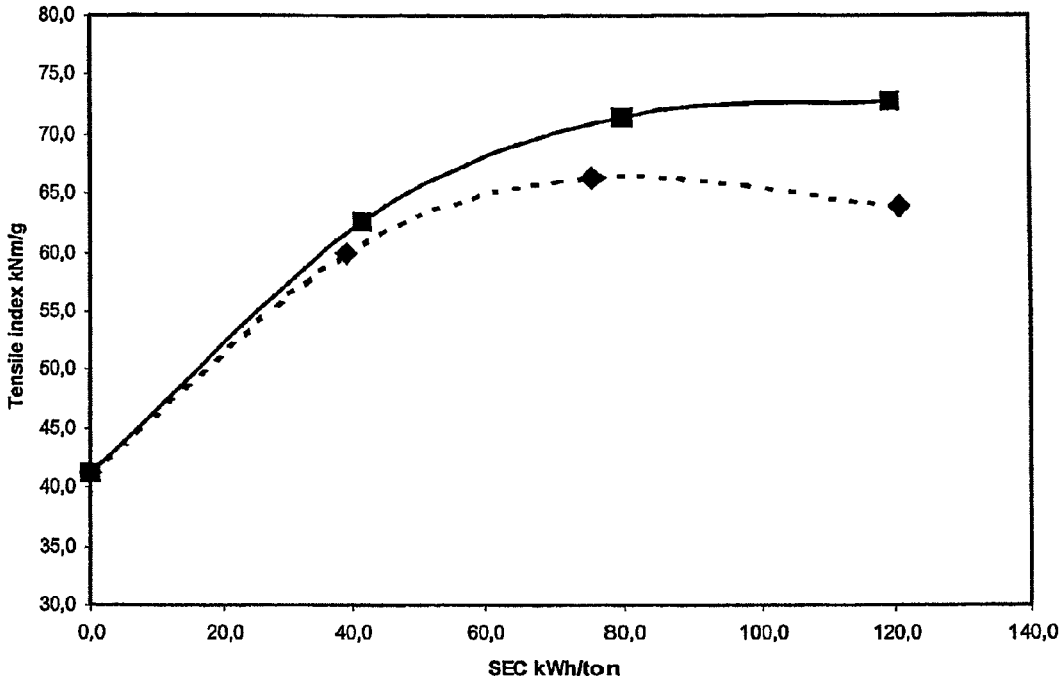
Figure 22:
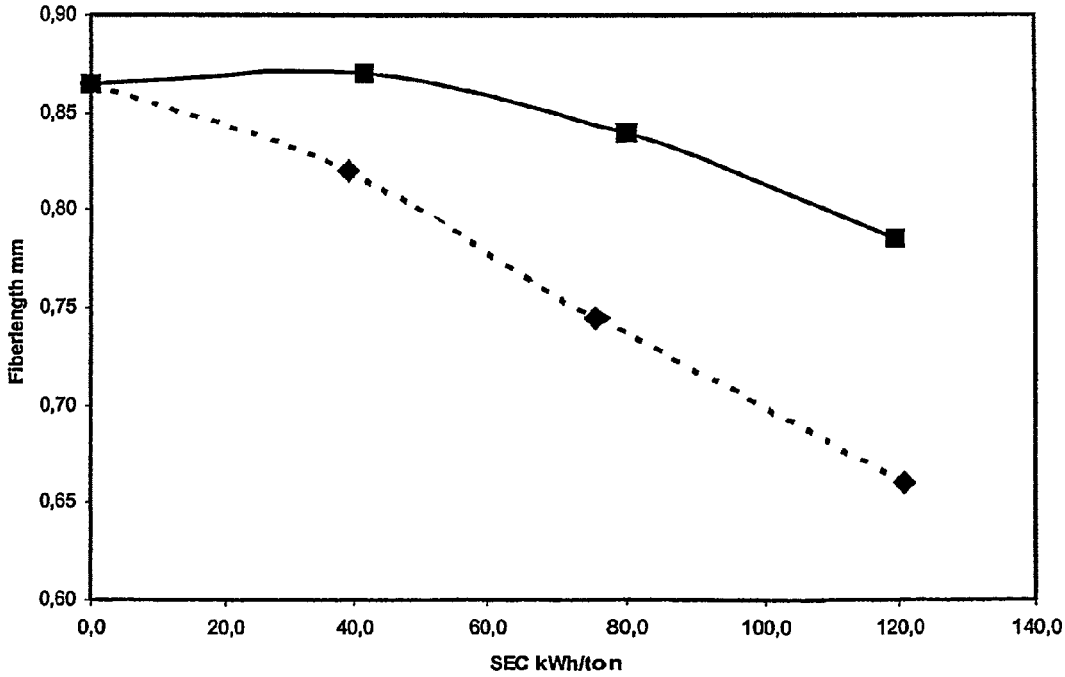
Figure 23:
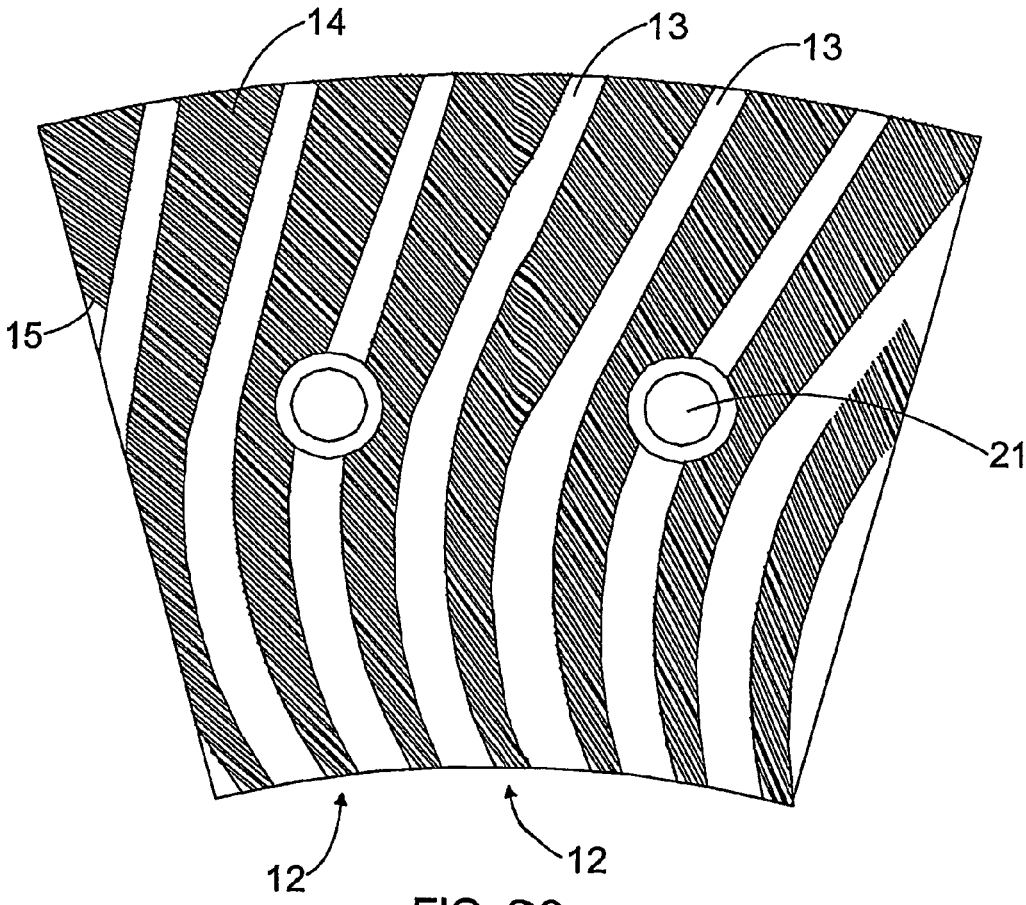

The invention will now be described in more detail in the attached drawings, in which FIG. 1 schematically shows a side view of a typical disc refiner in cross-section, FIG. 2 schematically shows a side view of a typical cone refiner in cross-section, FIG. 3 schematically shows a part of a refining surface of a disc refiner, seen in the direction of the refining surface, FIG. 4 schematically shows a top view of a first bar of the refining surface according to FIG. 3, FIG. 5 schematically shows a cross-section of the bar according to FIG. 4 along line V-V of FIG. 4, FIG. 6 schematically shows a second refining surface of the disc refiner, seen in the direction of the refining surface, FIG. 7 schematically shows a third refining surface of the disc refiner, seen in the direction of the refining surface, FIG. 8 schematically shows a part: of a refining surface of the rotor of a cone refiner, seen in the direction of the refining surface, FIG. 9 schematically shows a part of a refining surface of the stator of a cone refiner, seen in the direction of the refining surface, FIG. 10 schematically shows a cross-section of the refining surface according to FIG. 8 along line C-C of FIG. 8, FIG. 11 schematically shows a cross-section of the refining surface according to FIG. 9 along line C-C of FIG. 9, FIG. 12 schematically shows a detail of the refining surface in cross-section, FIG. 13 schematically shows a part of a refining surface of a refiner, seen in the direction of the refining surface, FIG. 14 schematically shows a cross-section of the refining surface according to FIG. 13, FIGS. 15*a* and 15*b* schematically show two embodiments of the refining surfaces, seen in the direction of the refining surfaces, and FIGS. 16*a* and 16*b* schematically show the refining surfaces according to FIGS. 15*a* and 15*b* in detail in cross-section, FIG. 17 schematically shows a refining surface of a cone refiner, FIG. 18 schematically shows a refining surface according to the solution being used in a double disc refiner, FIGS. 19 to 22 schematically show test run results achieved with both a conventional refining surface and the refining surface according to the solution and FIG. 23 schematically shows a blade segment of a refiner.

For the sake of clarity, the invention is shown simplified in the figures. Like parts are denoted with like reference numerals in the figures.

DETAILED DESCRIPTION OF THE INVENTION

FIG. 1 shows schematically a side view of a typical disc refiner in cross-section. The disc refiner comprises two disc-like refining surfaces 1 and 2 of adjacent refining members, which are positioned coaxially relative to each other. In this embodiment, the first refining surface 1 is in a rotating refiner disc or refining member 3, i.e. a rotor, which is rotated by a shaft 4. The second refining surface 2 is in this case in a fixed refiner disc or refining member 5, i.e. a stator. The refining surfaces 1 and 2 of the refiner discs 3 and 5 may be either formed directly onto the discs or formed of separate blade segments in a manner known per se. FIG. 1 shows further a loader 6 connected to affect the refiner disc 3 via the shaft 4 in such a way that it can be pushed towards the refiner disc 5 to adjust the gap between them. The refiner disc 3 is rotated via the shaft 4 in a manner known per se by means of a motor not shown for the sake of clarity.

The lignocellulose-containing material to be defibrated is fed through an opening 7 in the middle of the second refining surface 2 to the gap between the refining surfaces 1 and 2, i.e. the refiner gap, where it is defibrated and refined. The material to be defibrated can be fed into the refiner gap also through other openings on the refining surface 2, which are not shown in the figure for the sake of clarity. The lignocellulose-containing material that has been defibrated is discharged through the gap between the refiner discs 3 and 5 from the outer edge of the refiner gap, i.e. the outer circumference of the refiner discs 3 and 5, into a refiner chamber 8, from where it is further discharged along a discharge channel 9. Thus, at the opening 7 in the middle of the refining surface 2 there is the feed point or feed side for the fibrous material to be refined and at the outer circumference of the refiner discs 3 and 5 there is the discharge side or discharge point for the refined fibrous material.

FIG. 2 shows schematically a side view of a typical cone refiner in cross-section. The cone refiner comprises two conical refining surfaces 1 and 2 of adjacent refining members, which are positioned within each other coaxially. In this embodiment, the first refining surface 1 is in a rotating conical refiner disc or refining member 3, i.e. a rotor, which is rotated by means of the shaft 4. The second refining surface 2 is in a fixed conical refiner disc or refining member 5, i.e. a stator. The refining surfaces 1 and 2 of the refiner discs 3 and 5 may be either formed directly onto the discs or formed of separate blade segments in a manner known per se. Further, FIG. 2 shows a loader 6 connected to affect the refiner disc 3 via the shaft 4 so that it can be pushed towards the refiner disc 5 to adjust the gap between them. The refiner disc 3 is rotated via the shaft 4 in a manner known per se by means of a motor not shown for the sake of clarity.

The lignocellulose-containing material to be defibrated is fed through an opening 7 in the middle of the second refining surface 2, i.e. from the end of the cone structure having the smaller diameter, into a conical gap between the refining surfaces 1 and 2, i.e. a conical refiner gap, where it is defibrated and refined. The material that has been defibrated is discharged through a gap between the refiner discs 3 and 5 from the outer edge of the refiner gap, i.e. from the end of the cone structure with the larger diameter, into the refiner chamber 8, from which refiner chamber 8 it is further discharged along the discharge channel 9. At the opening 7 in the middle of the refining surface 2 there is the feed point or feed side for the fibrous material to be refined and at the end of the refiner discs 3 and 5 having the larger diameter there is the discharge side or discharge point for the refined fibrous material.

FIG. 3 shows a part of a refining surface of a refining member of a disc refiner intended for refining fibrous material with a high concentration. The refining surface is provided with a pattern of first bars 12 and first grooves 13 between them. FIG. 4 shows an embodiment of the bars 12 of the refining surface in FIG. 3, and FIG. 5 shows a section along line V-V of FIG. 4. The first bars 12 have upper surfaces 18 and side surfaces 19 with edges 20. The pattern of bars 12 is divided into two refining surface zones 16, the inner zone 16. and the outer zone 16', whereby the bars 12 and the grooves 13 in the inner zone 16 are more sparsely distributed than in the outer zone 16'. The bars 12 in the inner zone 16 are intended for bringing about a first disintegration of the material and for advancing the material outward to the outer zone 16'. The bars 12 in the outer zone 16' are placed more closely to each other, which means that there are more bar edges for effecting the substantial working and refining of the material. The pattern of bars 12 can also comprise more zones, whereby the pattern is usually made denser from zone to zone in the radially outward direction.

FIG. 4 shows an embodiment where a plurality of smaller grooves or second grooves 15 are placed along the bars 12, which grooves are arranged slightly angular in relation to the longitudinal direction of the bars 12 and are open to both side surfaces of the bars 12. Due to the bars 12 provided with oblique, smaller second grooves 15 on the upper surfaces 18, the first bars 12 as well as the first grooves 13 between them can be made wider without that the working upper surface of the bars 12 loses its effectiveness. By the wider first grooves 13, the steam and, respectively, liquid flow in the grooves 13 is facilitated and the disturbance of the working of the fibrous material is minimized.

FIG. 6 shows another embodiment of the bars 12. Unlike in FIG. 4, the bars 12 are arcuate or arc-shaped. The smaller second grooves 15 on the upper surface 18 of the bars 12, however, are always oblique in relation to the longitudinal direction of the bars 12. The second grooves 15 therein should be suitably in the substantially radial direction.

According to FIG. 7, the smaller grooves 15 are angular in different directions, preferably in such a way that they cross each other on the upper surface of the bars 12. Alternatively, they can be offset in the longitudinal direction of the bars 12 so that they do not cross each other. These embodiments allow that the rotation direction of the refiner discs can be changed.

FIG. 8 shows schematically a blade segment 10 forming a part of a refining surface 1 of the rotor of a cone refiner, seen in the direction of the refining surface 1. FIG. 9 shows schematically a blade segment 11 forming a part of a refining surface 2 of the stator, seen in the direction of the refining surface 2. The refining surfaces 1 and 2 comprise blade bars 12, i.e. bars 12. The bars 12 form first bars of the refining surfaces 1 and 2. Between the bars 12 there are grooves 13 forming first grooves of the refining surfaces 1 and 2. The upper surface of the bars 12 is provided with a dense structure of grooves, comprising grooves 15 and bars 14 between them. The bars 14 form second bars of the refining surfaces 1 and 2. The grooves 15 form second grooves of the refining surfaces 1 and 2. The bars 14 and grooves 15 of the refining surface 1 of the rotor are schematically shown in FIG. 10, which illustrates a cross-section of the refining surface 1 along line C-C of FIG. 8. The bars 14 and grooves 15 of the refining surface 2 of the stator are schematically shown in FIG. 11 illustrating a cross-section of the refining surface 2 along line C-C of FIG. 9.

The refining surfaces according to FIGS. 3 to 11 are characterized in that the refining surfaces comprise first bars 12 and first grooves 13 between the first bars 12. Further, the upper surface 18 of the first bars 12 comprises second bars 14, between which there are second grooves 15. In their direction of travel, the second bars 14 are narrower than the first bars 12, and the second grooves 15 are also in their direction of travel narrower than the first grooves 13. The upper surface of the first bars 12 is thus provided with a dense structure of grooves, i.e. a structure of microgrooves, for refining the lignocellulose-containing material. The refining surfaces are formed in such a manner that the total area of the microgrooved refining zones formed of the upper surfaces of the bars 12 equals 60 to 90% of the total area of the refining surfaces. The refining surfaces are preferably formed in such a manner that the total area of said microgrooved refining zones is 70 to 80% of the total area of the refining surfaces.

The purpose of the microgrooved refining zones on the upper surface of the bars 12 is to refine said lignocellulose-containing fibrous material. Between the refining surfaces 1 and 2 of the refiner there is a small clearance, due to which the refining of said fibrous material takes place between the refining surfaces 1 and 2. The purpose of the first grooves 13 is to transport fibrous material to be refined to the refining zones formed of the microgrooved upper surfaces of the bars 12 and to transport the refined material away from between the refining surfaces 1 and 2. In addition, the purpose of the first grooves 13 in high-consistency refining is to transport water vapor produced during refining away from between the refining surfaces 1 and 2.

The refining surfaces 1 and 2 of the refining members can be implemented in various ways. For instance, the first bars 12 and the first grooves 13 between them on the refining surfaces can be formed in a variety of ways in respect of their size and shape. The bars 12 can be, for instance, 15 to 80 mm, preferably 20 to 40 mm, wide. The width of the grooves 13 between the bars 12 can be, for instance, 5 to 40 mm, preferably 10 to 30 mm, for example. Both the bars 12 and the grooves 13 can be formed in such a way that their width remains the same or changes according to the direction of travel of the bars or grooves. The depth of the grooves 13 can be 10 to 40 mm, for example. The grooves 13 can be formed in such a way that the depth thereof remains the same or changes in the direction of travel of the grooves. It can be said that as the width and/or depth of the groove 13 changes, the cross-sectional area of the groove 13 or the volume of the groove 13 changes. Thus, the cross-sectional flow area of the grooves 13 can vary between 0.5 and 15 $cm^2$.

As to the shape of the bars 12, they can either extend directly in the radial direction of the refining surface from the shaft or first radial edge of the refining surface to the outer circumference or second radial edge of the refining surface or the bars 12 can be curved at a standard or a varying angle from the shaft of the refining surface to the outer circumference of the refining surface, whereby the edges of the bars 12 can be curved uniformly or they may have steps. The shape of the bars 12 naturally determines the shape of the grooves 13 between the bars 12. Further, the bars 12 can be formed in such a way that they are pumping at the feed end of the fibrous material to be refined and retentive or non-pumping at the discharge end of the refined fibrous material, which is why it is possible to compensate for a low pumping centrifugal force on the feed side and a high pumping centrifugal force on the discharge side. An example of this is shown in FIG. 23 wherein the first bars 12 are pumping at the feed end and non-pumping at the discharge end. In this example the second bars 12 are pumping throughout the blade segment according to FIG. 23. The attachment points of the blade segment are denoted with reference numeral 21.

A pumping blade bar means that when the refiner rotor rotates in the pumping direction, the blade bar produces for the mass particle both a circular or angular velocity component and a radial velocity component directed away from the centre, whereby the mass particle tends to move away from between the refiner discs. A retentive blade bar, for its part, means that when the refiner rotor rotates in the retentive direction, the blade bar produces for the mass particle both a circular or angular velocity component and a radial velocity component directed towards the centre, whereby the mass particle tends to remain between the refiner discs.

The width of the second grooves formed on the upper surface of the first bars 12 can be 1 to 3 mm, for instance. Also the width of the second bars 14 which remain between the second grooves 15 can be 1 to 3 mm, for example. The average width of the first bars 12 is thus about 2.5- to 40-fold in respect of the combined average width of the second bars 14 and the second grooves 15 (combined unit). The bars 14 and the grooves 15 may have a constant width in their direction of travel but said width of the bars 14 and the grooves 15 can also change in their direction of travel. Said second bars 14 and second grooves 15 are thus positioned as densely as possible on the upper surface of the first bars 12 so that the cutting length of the refining zones of the refining surfaces 1 and 2 becomes as great as possible.

The bars 14 and the grooves 15 can be formed on the upper surface of the bars 12 in such a manner that they form an angle of about 5 to 30° to the radius of the refining surface in one direction or another. The bars 14 can be formed such that with a specific radius, the angle of attack of the bars 14 on the opposing refining surfaces is constant over the entire area of the refining surface. The grooves 15 can be formed such that they can be either pumping or retentive. When the grooves 15 are pumping, the pulp is taken more effectively towards the discharge, thus achieving a uniform refining result. If the grooves 15 are retentive, the refining result is not so uniform but, on the other hand, the residence time distribution of the fibrous material is greater. Thus, to achieve a uniform refining result, refining surfaces are used, the second grooves 15 of which are pumping. If it is more important to achieve a long refining treatment of fibrous material than a uniform refining result, refining surfaces are used, the grooves 15 of which are retentive. The grooves 15 can also be implemented in such a manner that the purpose thereof is not to affect the time the material to be refined remains between the refining surfaces.

The second grooves 15 on the upper surface of the bars 12 can be, for instance, 3 to 5 mm deep. Thus, the first grooves 13 are at least twice as deep as the second grooves 15. In practice, the greatest groove depth of the grooves 15 is determined by the thickness of the wear surface of the refining surfaces. The depth of the groove 15 can either be constant or vary in the direction of travel of the groove 15. The depth of the groove 15 can also vary in the width direction of the groove 15 so that, for instance, the groove 15 is deeper on the front side than on the back side, which produces a lifting force and the blade does not cut through the fiber matting nor break the fibers. The front side refers to the front edge of the groove 15 and the back side to the back edge of the groove 15, when seen in the rotation direction of the refiner disc. This solution is shown schematically in FIG. 12, which illustrates a first bar 12 in cross-section. Such a solution can be advantageous when the aim is to achieve a high load capacity for the postrefining of mechanical pulp or for short-fibred pulp. In the refining of long-fibred pulp, the grooves 15 can have an equal depth or they can even be deeper on the back side of the groove than on its front side.

The refining surface according to the solution makes it possible that in the refining, a very small load on the bar can be used without impairing the hydraulic capacity of the refiner. Usually when long-fibred pulp is refined with short-fiber blades intended for refining short fibers, a sufficient hydraulic capacity is not achieved and the blades of the refiner are blocked. On the refining surface according to the solution, grooves 13 with a clearly larger volume than previously enable an optimal, constant feed of the fibrous material to be refined in the entire area of the refining surface. Due to the bars 14 and grooves 15 on the upper surface of the bars 12 and forming the refining zones of the refining surfaces 1 and 2 and providing a clearly denser structure of bars and grooves than the previously known solutions, a high cutting length can be achieved on the refining surface. The refining surface of the solution can thus provide a desired capacity and a good quality of the refined pulp. In addition, unlike previously, the same refining surface solution can be applied to the refining of both long and short fibers. Further, with a specific energy consumption which is 10 to 20% lower than before, the refining surface of the solution provides the same quality or strength change as previously. Furthermore, by using the same cutting length as before, the refiner can be used with a load that is 20% greater without any blade contact. Also, a greater power can be used without decreasing the fiber length of short fibers, which means that short-fiber refining can be carried out by using fewer refiners.

Figure 19:
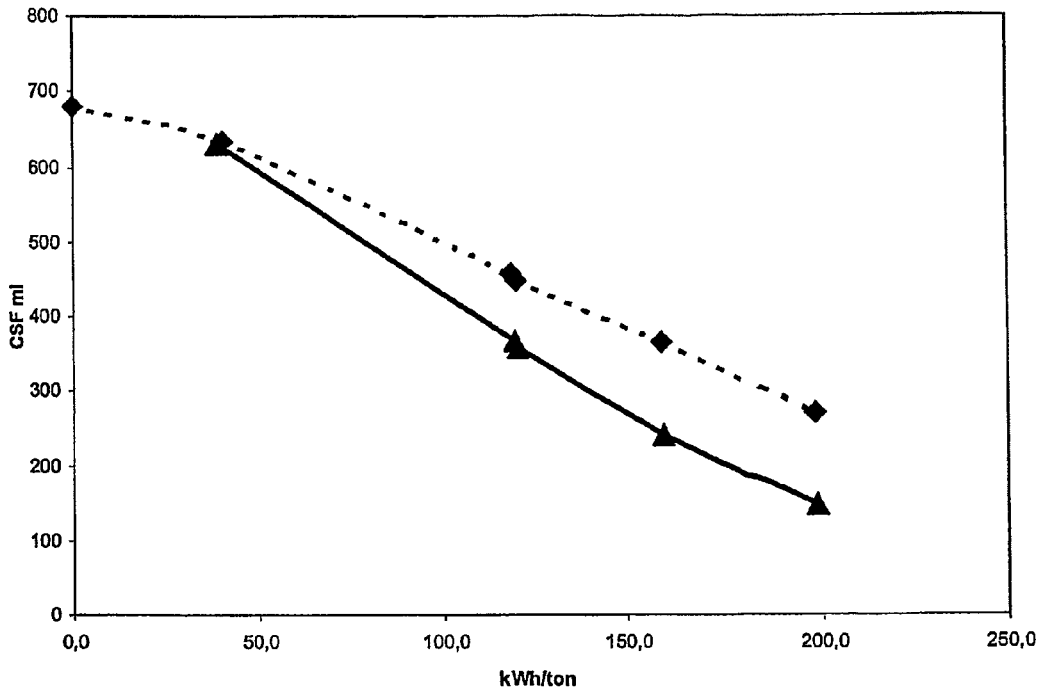
Figure 20:
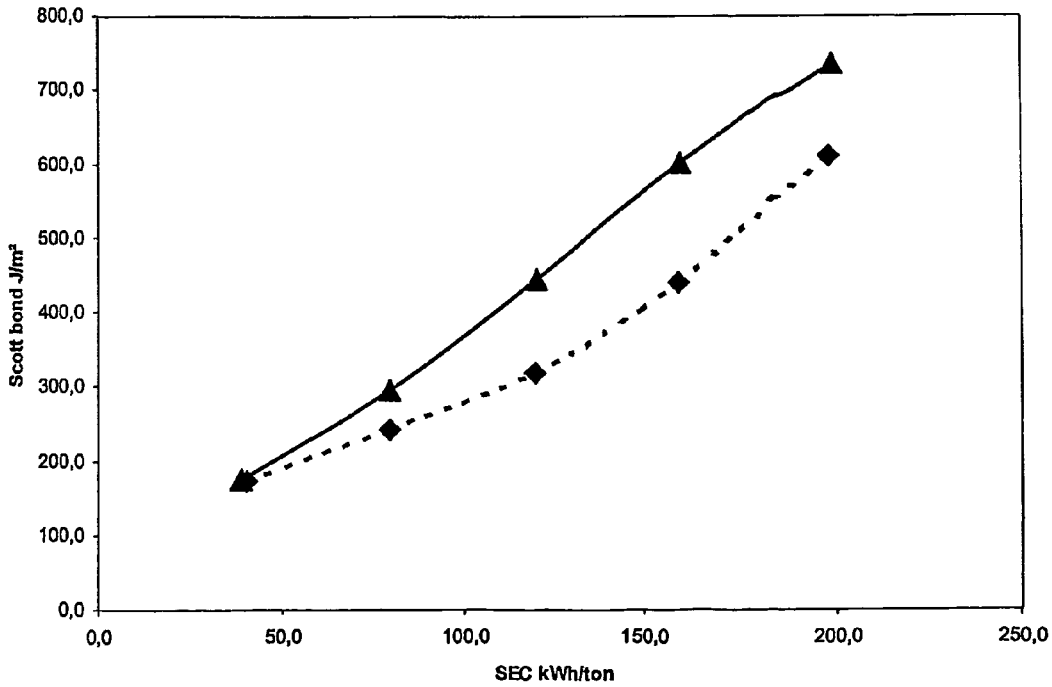

FIGS. 19 to 22 show test run results achieved with both a conventional refining surface and the refining surface according to the solution. FIG. 19 shows a situation in which long fibers are refined with the conventional refining surface (broken line) and with the refining surface according to the solution (continuous line). The purpose was to increase the refining degree, i.e. freeness of pulp from the value of CSF 700 ml to the value of CSF 300 ml. It appears from FIG. 19 that, in the case of the conventional refining surface, 185 kWh/ton of energy was needed to increase said refining degree, whereas the energy demand in the case of the refining surface of the solution was only 140 kWh/ton, which corresponds to an energy saving of 25%. FIG. 20, in turn, shows that the bonding strength (Scott Bond) of pulp developed clearly faster when the refining surface of the solution was used. In the case of the refining surface of the solution (continuous line), 120 kWh/ton of energy was needed to achieve the bonding strength of 400 $J/M^2$, whereas the energy demand of the conventional refining surface was 150 kWh/ton. Thus, particularly when long fiber is refined, the refining surface of the solution provides considerable energy savings in comparison with the conventional refining-surface.

FIG. 21 shows a situation where short fibers are refined with the conventional refining surface (broken line) and with the refining surface according to the solution (continuous line). The purpose was to increase the tensile index of the fiber from the starting value of 41 kNm/g. On the basis of the test run, it was not reasonable to load the conventional refining surface more than 80 kWh/ton, because, after this, the tensile index started to become lower. In this case, the tensile index of a specimen made of the test run pulp was 67 kNm/g. At the same time as the tensile index started to become lower, the distance between the refining surfaces of the refiner became shorter, which caused a risk of a harmful contact between the opposing refining surfaces. The refining surface of the solution did not have this problem, wherefore higher tensile indexes were achieved and the load capacity of the refiner was maintained until the end and the test produced a tensile index of 73 kNm/g with a refining energy of 120 kWh/ton.

FIG. 22 shows how the fiber length changes in the case of the refining surface of the solution (continuous line) and in the case of the conventional refining surface (broken line). Although there was no essential difference between the cutting lengths of the conventional refining surface and the refining surface of the solution, the conventional refining surface cut the fiber, whereas the fiber length did not essentially decrease by using the refining surface of the solution. With an energy consumption of 120 kWh/ton in the refining, the fiber length decreased from 0.87 mm to 0.78 mm when the refining surface of the solution was used, whereas in the case of the conventional refining surface, the fiber length decreased to 0.66 mm and a contact occurred between the refining surfaces. Particularly in the refining of short fibers, the refining surface of the solution provides, above all, the advantage of a higher load capacity of the refiner since, conventionally, if the refiner is loaded too much, the refining surfaces will have a harmful contact. Thus, more energy can be consumed per each mass ton, without decreasing the fiber length substantially or having a contact between the refiner surfaces. The refining surface of the solution is thus particularly suitable for fibers which are sensitive to overload and to a refiner surface contact. Examples of such situations include postrefining of mechanical pulp and short-fibered mechanical pulp and refining of chemical pulp and recycled fiber pulp.

Bars with a design presented above can be placed in any zone on the refining surface, but preferably at least in the outer zone where the working and refining are most intensive and the distance between the opposing refining surfaces is the shortest, i.e. the refining gap is the smallest and possible steam development the greatest. During the working of fibrous material with the refining surfaces presented above, the upper surfaces of the bars 12 and the edges of the smaller second grooves will work on the material. The steam the development of which arises in the case of a high concentration refining and the liquid flow that passes through the refining gap in the case of a low concentration refining are led away from the upper surfaces of the bars 12 and can pass out through the grooves 13 between the bars 12 so that the working of the fibrous material is not disturbed. In this way, a high capacity can be achieved and the pulp quality maintained. By providing the refining surfaces with arc-shaped first bars 12 with substantially radial, smaller second grooves 15 on the upper surface, an increased capacity can be obtained and, at the same time, a high pulp quality achieved so that the smaller second grooves 15 bring about an effective fibrillation of the fibrous material.

FIG. 13 shows schematically a part of a refining surface, seen in the direction of the refining surface, and FIG. 14 shows schematically the refining surface according to FIG. 13 in cross-section in the longitudinal direction of the groove 13. In the refining surface according to FIGS. 13 and 14, the number of the second bars 14 increases from zone to zone from the feed side of-the refining surface to the discharge side of the refining surface. Thus, seen from the feed end of the refiner, the first refining surface zone comprises the lowest number of second bars 14 and the last refining surface zone the highest number of second bars 14. This can be implemented, for instance, so that in the first refining surface zone seen from the feed end, the width of the second grooves 15 between the second bars 14 corresponds to the maximum value of the variation range of the groove width presented above, and in the last refining surface zone, the width of said grooves 15 corresponds to the minimum value of the variation range of said groove width. The refining surface zones are denoted in FIG. 13 with reference numeral 16. Of course, as seen from FIG. 13, the second grooves 15 between the second bars 14 can also be essentially wider at the feed end than at the discharge end.

FIG. 14 also shows how the depth of the second groove 15 changes so that the depth of the groove 15 at the end of each refining surface zone is smaller than at the beginning of the next refining surface zone. Hence, the grooves 15 become lower step by step towards the discharge side. This leads to a half-dam, which physically hinders return flows of the refined material. The grooves 15 could also be implemented in such a way that they become steadily lower towards the discharge side. The depth of the second grooves 15 on the upper surface of the first bars 12 and the depth of the first grooves 13 are dimensioned, for instance, so that the maximum values of the variation ranges of the groove depths mentioned above are used on the feed side and the minimum values of the variation range of said groove depths are used on the discharge side.

The embodiment according to FIGS. 13 and 14 is characterized in that the cross-sectional flow area of the refining surface remains the same or becomes smaller towards the discharge of the material to be refined, whereby the flow rate of the fibrous material to be refined remains the same or becomes higher towards the discharge. A stepwise denser structure of the refining surface decreases the cross-sectional flow area, whereby the smaller cross-sectional flow area is compensated for by making the grooves deeper. On the other hand, as the number of grooves increases in the direction of the outer circumference of the refining surface, the bigger cross-sectional flow area is compensated for by lower grooves. This provides even flow of the refined material and fiber treatment in which the return flows of the refined material can be minimized and the residence time distribution decreased so that all fibers are provided with as uniform treatment as possible. A uniform fiber treatment is advantageous in applications where a high strength and density of paper is required without decreasing the paper porosity. Also the smoothness and quality of the paper surface improve as the number of unrefined fibers decreases. In addition, it is easier to control the pressure rise between the refiner discs, as a result of which the refiner runs more smoothly and does not have so much vibrations and has a no-load operation power that is about 20 to 30% smaller than before.

FIGS. 15*a* and 15*b* show a part of a refining surface, seen in the direction of the refining surface, and FIGS. 16*a* and 16*b* show the refining surface according to FIGS. 15*a* and 15*b* in cross-section. For the sake of clarity, in the embodiment according to FIGS. 15*a*, 15*b*, 16*a* and 16*b*, one or more foils 17 are provided on the refining surface 1 of the rotor plate 3 of the refiner, for example, by casting. The foil 17 is placed onto the bottom of the first groove 13.

The foils 17 are placed onto the refining surface of the rotor plate 3 such that when the rotor rotates in the pumping direction, the foils 17 produce a lifting force. At the same time, a power is produced in the stator, restricting the pumping effect of the bars 12 and simultaneously causing an effective mixing of the fibers and water, which prevents the refining surfaces from being blocked. In addition, due to the suction effect caused by the foils 17, the grooves of the refining surface of the stator are cleaned. When such a rotor provided with foils 17 rotates in the non-pumping direction, the foil 17 acts as a pumping part causing a push force, which intensifies the pumping effect and improves the passing through of the fiber materials. The push force of the foil 17 causes a pressure pulse, which pushes the pulp through the refiner. Due to the solution, the refiner throughput difference between the pumping and non-pumping directions of the rotor becomes smaller.

The foil can be continuous and be located on the blade surface either radially or in a curved manner. A radial foil provides a stronger pulse than a curved one. The foil can also consist of bits. The foil bits can also be randomly placed on the refining surface. Typically, the foil has a length of 30 to 80 mm, preferably 50 to 60 mm, the length being defined in the transverse direction to the first groove. The depth of the foil can be, for instance, about 20 mm, and the shortest distance of the foil from the counter surface is, for instance, 3 mm in the beginning. As the refining surfaces wear, the distance becomes shorter and the power of the suction pulse becomes higher. The frequency of the desired suction pulses can be controlled by changing the number of foils on the refining surface.

Foils and a gradually denser structure of bars and grooves as well as either a stepwise or a regular change in the groove depth can naturally also be utilized as such in other refining surface solutions than in the refining surfaces provided with both the first bars 12 and first grooves 13 and the second bars 14 and second grooves 15. Thus, these features can be utilized, for example, in the refining surfaces according to FIGS. 1 and 3 of U.S. Pat. No. 4,676,440 or in the refining surface according to FIG. 17. FIG. 17 shows schematically a refining surface, which only comprises second grooves 15 and second bars 14 arranged densely with respect to each other and which are known as microgrooves and micro bars. The refining surface of FIG. 17 is one solution as a refining surface of the stator, the refining surface of the rotor being in accordance with the above description. The refining surface of FIG. 17 can especially be used as a counter surface for the refining surfaces shown in FIGS. 13 to 16. A counter surface can naturally also be any previously known refining surface solution.

FIG. 18 shows schematically a refining surface according to the solution being used in a double disc (DD) refiner. In the middle of FIG. 18 there are two rotor plates attached to each other on their backsides and one refiner stator plate on each side of the rotor plates. Refining surfaces of said rotor plates are normally mirror images of each other and so are the two stator plates, i.e. if one of the two slots of the refiner function pumping then so does the other one, too, by which the functioning of the two-slot refiner of FIG. 18 is ensured, i.e. the gaps between the plates of the slots can be kept under control. The two-slot refiner can be changed from pumping to non-pumping by changing both rotor plates and stator plates among each other. By doing so the refiner is changed from pumping to non-pumping without changing the rotation direction of the refiner. The two-slot refiner can be changed from pumping to non-pumping also by changing the rotation direction of the rotor. Further one possibility to change from pumping to non-pumping is to change only the rotor plates among each other. The case demands that stator plate design differs adequately from rotor plates because also after the change there have to be certain difference between blade bar angles of opposite refiner plates to avoid clashing of the plates. All the technical features presented also in FIGS. 13 to 17 can naturally be used with double disc refiners. Similarly all the technical advantages of the refining surface according to the solution are naturally present also in double disc refiners.

The drawings and the related description are only intended for illustrating the idea of the invention. In its details, the invention may vary within the scope of the claims. The examples of the figures describe different embodiments associated with refining surfaces of the stator and rotor of either a disc refiner or a cone refiner, but it is naturally obvious that what is explained about the structure of the refining surfaces of the rotor and stator of a cone refiner, can also be applied, to the appropriate extent, to the structures of the refining surfaces of the stator and rotor of a disc refiner, and vice versa.

That which is claimed:

1. A refining surface of a refining member adapted for use with a refiner for defibrating a lignocellulose-containing material, the refiner comprising at least two adjacently-disposed refining members arranged coaxially relative to each other along an axis, wherein at least one of the refining members is configured to rotate in a rotational direction about a shaft arranged along the axis, and the at least two refining members are configured to receive the lignocellulose-containing material in a refining gap therebetween, the refining gap defining a refining plane, such that the material is defibrated by the respective refining surface of each refining member within the refining gap, the refining surface of the refining member parallel to the refining plane comprising:

a plurality of first bar portions defining first grooves between adjacent first bar portions, each first groove having a bottom surface, each first bar portion extending between opposing first and second radial edges of the refining surface and having a leading surface, an opposed trailing surface, each with respect to the rotational direction, and an upper surface, each of the leading and trailing surfaces being configured to extend away from the bottom surfaces of the respective first grooves such that the upper surface of each first bar portion is substantially planar and parallel to the refining plane; and the upper surface of each first bar portion having a plurality of second bar portions defining second grooves between adjacent second bar portions, each second bar portion extending between two adjacent first grooves, the first bar portions being wider than the second bar portions, and each second bar portion being between about 1 mm and about 3 mm wide.

2. A refining surface of a refining member according to claim 1, wherein the first bar portions have an average first bar portion width, and wherein one of the second bar portions and adjacent second groove define a combined unit, the combined units having an average combined unit width, the average first bar portion width being between about 2.5 times and about 40 times the average combined unit width.

3. A refining surface of a refining member according to claim 1, wherein the refining surface of the refining member defines a total surface area, and wherein the second bar portions and the second grooves collectively define a refining zone having a refining zone area, the refining zone area being between about 60% and about 90% of the total surface area.

4. A refining surface of a refining member according to claim 3, wherein the refining zone area is between about 70% and about 80% of the total surface area.

5. A refining surface of a refining member according to claim 1, wherein each of the first bar portions has a width of between about 15 mm and about 80 mm, each of the first grooves has a width of between about 5 mm and about 40 mm and a depth of between about 10 mm and about 40 mm.

6. A refining surface of a refining member according to claim 1, wherein the refining surface is further configured to have at least one of a varying first bar portion width, a varying first groove width, and a varying first groove depth, between the first and second radial edges.

7. A refining surface of a refining member according to claim 1, wherein the first grooves are configured in a pumping configuration toward the first radial edge of the refining surface and in a retentive configuration toward the second radial edge of the refining surface, and wherein the lignocellulose-containing material is fed into the refiner toward the first radial edge and discharged from the refiner toward the second radial edge.

8. A refining surface of a refining member according to claim 1, wherein each of the second grooves has a width of between about 1 mm and about 3 mm and a depth of between about 3 mm and about 5 mm.

9. A refining surface of a refining member according to claim 1, wherein the refining surface is further configured to have at least one of a varying second bar portion width, a varying second groove width, a varying second groove depth, between the two adjacent first grooves.

10. A refining surface of a refining member according to claim 1, wherein the refining member defines a radius, and the second bar portions and second grooves are arranged on the first bar portions so as to define an angle of between about 5° and about 30° with respect to the radius.

11. A refining surface of a refining member according to claim 1, wherein the lignocellulose-containing material is fed into the refiner toward the first radial edge and discharged from the refiner toward the second radial edge, wherein the second grooves vary in width over a range having an upper limit and a lower limit, wherein the second grooves toward the first radial edge of the refining surface are configured to be toward the upper limit of the width range and the second grooves toward the second radial edge of the refining surface are configured to be toward the lower limit of the width range, and wherein less second bar portions are disposed toward the first radial edge than toward the second radial edge of the refining surface.

12. A refining surface of a refining member according to claim 11, wherein the refining surface includes at least one refining surface zone between the first and second radial edges, and wherein the second grooves in each refining surface zone are deeper toward the first radial edge than toward the second radial edge of the refining surface.

13. A refining surface of a refining member according to claim 12, wherein each of the at least one refining surface zone includes a step in each of the second grooves disposed toward the first radial edge of the respective zone, the step being configured to minimize backflow of the lignocellulose-containing material toward the first radial edge.

14. A refining surface of a refining member according to claim 1, wherein, when the refining member comprises a rotor of the refiner, the refining surface further comprises at least one foil configured such that, when the rotor is rotated in a pumping direction, the at least one foil is arranged to produce a lifting force for directing the lignocellulose-containing material between the at least two refining members to intensify mixing of fibers of the lignocellulose-containing material with water and, when the rotor is rotated in a non-pumping direction, the at least one foil is arranged to produce a pushing force for increasing a progression rate of the lignocellulose-containing material from the first radial edge toward the second radial edge.

15. A refining surface of a refining member according to claim 14, wherein the at least one foil is disposed within each of the first grooves.

16. A refining surface of a refining member according to claim 15, wherein the at least one foil extends transversely for between about 30 mm and about 80 mm, preferably between about 50 mm and about 60 mm, across each of the first grooves.

17. A refining surface of a refining member according to claim 1, wherein the first bar portions extend substantially linearly between the first and second radial edges of the refining surface.

18. A refining surface of a refining member according to claim 1, wherein the first bar portions extend arcuately between the first and second radial edges of the refining surface.

19. A blade segment of a refining member adapted for use with a refiner for defibrating a lignocellulose-containing material, the refiner comprising at least two adjacently-disposed refining members arranged coaxially relative to each other along an axis, wherein at least one of the refining members is configured to rotate in a rotational direction about a shaft arranged along the axis, and the at least two refining members are configured to receive and defibrate the lignocellulose-containing material in a refining gap therebetween, the refining gap defining a refining plane, the blade segment forming at least a portion of the refining member parallel to the refining plane and comprising:

a refining surface having a plurality of first bar portions defining first grooves between adjacent first bar portions, each first groove having a bottom surface, each first bar portion extending between opposing first and second radial edges of the refining surface and having a leading surface, an opposed trailing surface, each with respect to the rotational direction, and an upper surface, each of the leading and trailing surfaces being configured to extend away from the bottom surfaces of the respective first grooves such that the upper surface of each first bar portion is substantially planar and parallel to the refining plane;

the upper surface of each first bar portion having a plurality of second bar portions defining second grooves between adjacent second bar portions, each second bar portion extending between two adjacent first grooves, the first bar portions being wider than the second bar portions, and each second bar portion being between about 1 mm and about 3 mm wide.

20. A blade segment of a refining member according to claim 19, wherein the first bar portions have an average first bar portion width, and wherein one of the second bar portions and adjacent second groove define a combined unit, the combined units having an average combined unit width, the average first bar portion width being between about 2.5 times and about 40 times the average combined unit width.

21. A blade segment of a refining member according to claim 19, wherein the refining surface of the blade segment defines a total surface area, and wherein the second bar portions and the second grooves collectively define a refining zone having a refining zone area, the refining zone area being between about 60% and about 90% of the total surface area.

22. A blade segment of a refining member according to claim 21, wherein the refining zone area is between about 70% and about 80% of the total surface area.

23. A blade segment of a refining member according to claim 19, wherein each of the first bar portions has a width of between about 15 mm and about 80 mm, each of the first grooves has a width of between about 5 mm and about 40 mm and a depth of between about 10 mm and about 40 mm.

24. A blade segment of a refining member according to claim 19, wherein the refining surface is further configured to have at least one of a varying first bar portion width, a varying first groove width, and a varying first groove depth, between the first and second radial edges.

25. A blade segment of a refining member according to claim 19, wherein the first grooves are configured in a pumping configuration toward the first radial edge of the refining surface and in a retentive configuration toward the second radial edge of the refining surface, and wherein the lignocellulose-containing material is fed into the refiner toward the first radial edge and discharged from the refiner toward the second radial edge.

26. A blade segment of a refining member according to claim 19, wherein each of the second grooves has a width of between about 1 mm and about 3 mm and a depth of between about 3 mm and about 5 mm.

27. A blade segment of a refining member according to claim 19, wherein the refining surface is further configured to have at least one of a varying second bar portion width, a varying second groove width, a varying second groove depth, between the two adjacent first grooves.

28. A blade segment of a refining member according to claim 19, wherein the refining member defines a radius, and the blade segment is disposed such that the second bar portions and second grooves are arranged on the first bar portions so as to define an angle of between about 5° and about 30° with respect to the radius.

* * * * *